US009389043B1

(12) United States Patent
Zhang

(10) Patent No.: US 9,389,043 B1
(45) Date of Patent: Jul. 12, 2016

(54) FREE FLOATING RAIL FOR A FIREARM

(71) Applicant: Hongjun Zhang, Arcadia, CA (US)

(72) Inventor: Hongjun Zhang, Arcadia, CA (US)

( * ) Notice: Subject to any disclaimer, the term of this patent is extended or adjusted under 35 U.S.C. 154(b) by 0 days.

(21) Appl. No.: 14/732,225

(22) Filed: Jun. 5, 2015

(51) Int. Cl.
*F41C 23/16* (2006.01)

(52) U.S. Cl.
CPC ..... *F41C 23/16* (2013.01)

(58) Field of Classification Search
CPC ..... F41G 11/003; F41C 27/00; F41C 23/16
USPC ..... 42/85, 90, 72, 75.02, 75.03, 71.01
See application file for complete search history.

(56) References Cited

U.S. PATENT DOCUMENTS

| | | | | |
|---|---|---|---|---|
| 4,288,938 | A * | 9/1981 | Kahn | 42/59 |
| 8,464,457 | B2 * | 6/2013 | Troy et al. | 42/71.01 |
| 8,607,490 | B1 * | 12/2013 | Zinsner | 42/71.01 |
| 8,904,691 | B1 * | 12/2014 | Kincel | 42/71.01 |
| D724,171 | S * | 3/2015 | Trusty | D22/108 |
| 2011/0126443 | A1 * | 6/2011 | Sirois | 42/90 |
| 2012/0042557 | A1 * | 2/2012 | Gomez et al. | 42/90 |
| 2012/0186123 | A1 * | 7/2012 | Troy et al. | 42/71.01 |
| 2013/0055613 | A1 * | 3/2013 | Gomez et al. | 42/90 |
| 2014/0082991 | A1 * | 3/2014 | Clark | 42/146 |
| 2014/0144059 | A1 * | 5/2014 | Geissele | 42/71.01 |
| 2015/0168095 | A1 * | 6/2015 | Dubreuil | F41C 23/16 |

FOREIGN PATENT DOCUMENTS

DE 102013008241 A1 * 11/2014

* cited by examiner

*Primary Examiner* — Benjamin P Lee
(74) *Attorney, Agent, or Firm* — Che-Yang Chen; Law Offices of Scott Warmuth

(57) ABSTRACT

A rail is mounted solely to a barrel nut so that the rail is free-floating and does not affect movement of the barrel when the firearm is fired. The rail may have first and second wedges that are drawn together and frictionally engage a smooth exterior surface of the barrel nut in order to frictionally engage the wedges and the barrel nut. The first and second wedges have contact surfaces defined by a radius which is equal to a radius of the exterior surface of the barrel nut. By forming the contact surfaces of the first and second wedges to have a radius equal to the radius of the barrel nut, the maximum area of the contact surfaces contact or engage the exterior surface of the barrel nut to maximize frictional engagement between the barrel nut and the wedges.

6 Claims, 5 Drawing Sheets

FREE FLOATING RAIL FOR A FIREARM

CROSS-REFERENCE TO RELATED APPLICATIONS

Not Applicable

STATEMENT RE: FEDERALLY SPONSORED RESEARCH/DEVELOPMENT

Not Applicable

BACKGROUND

The various embodiments and aspects described herein relate to mounting of a free-floating rail to a barrel nut of a firearm.

Various means and ways of attaching a free-floating rail to a barrel or upper receiver of a firearm (e.g., AR rifle or AR pistol) exist. However, each of these systems has certain deficiencies.

Accordingly, there is a need in the art for an improved system for attaching the free-floating rail to the barrel nut.

BRIEF SUMMARY

A free-floating rail mounted to a barrel nut is disclosed herein. The free-floating rail is frictionally engaged to the barrel nut by use of two opposing wedges that clamp together and also push against the barrel nut in order to frictionally engage the barrel nut. By doing so, the installation of the free-floating rail is made simpler. The first and second wedges have radiused contact surfaces that match the radius of the exterior surface of the barrel nut in order to maximize and make effective the frictional engagement between the first and second wedges and the barrel nut so that the rail does not become loose after extensive firing of the firearm. When the firearm is being fired, the vibration does not cause the free-floating rail to dislodge off of the barrel nut.

More particularly, a rail mountable to a barrel nut of a firearm. The rail comprising an elongate tube, a first wedge and a fastener. The elongate tube may be sized and configured to fit over a barrel of the firearm. The elongate tube may define a proximal portion. The proximal portion may have a first aperture for providing access to an exterior surface of the barrel nut. The first wedge may be sized and configured to be received into the first aperture. The first wedge may be traversed between an engaged position wherein the first wedge directly contacts and applies pressure to the exterior surface of the barrel nut to frictionally hold the elongate tube onto the barrel nut of the firearm. The first wedge may also be traversed to a disengaged position wherein the first wedge does not apply sufficient pressure to hold the elongate tube on the barrel nut and allows the rail to be removed from the barrel nut. The fastener is attached to the first wedge for drawing the first wedge to the engaged position.

The rail may further comprise a second aperture and a second wedge. The second aperture may be formed at the proximal portion of the elongate tube for providing access to the exterior surface of the barrel nut. The second wedge may be sized and configured to be received into the second aperture. The second wedge may be traversed between the engaged position wherein the second wedge directly contacts and applies pressure to the exterior surface of the barrel nut.

The rail may have a mounting base. The rail may further comprise a bolt insertable through through holes of the mounting base and the second wedge and threadably attachable to a threaded hole of the first wedge.

The first and second wedges may each define a contact surface having a curvature. The curvature may have a radius equal to a radius of the exterior surface of the barrel nut.

The mounting base and the first and second wedges may be centered to a center of the rail so that the first and second wedges evenly applies pressure against the barrel nut.

In another aspect, a free floating rail system for attachment to a firearm is disclosed. The system may comprise a rail and a barrel nut. The rail may comprise an elongate tube, a first wedge and a fastener. The rail may be mounted to a barrel nut of a firearm. The rail may comprise an elongate tube, a first wedge and a fastener. The elongate tube may be sized and configured to fit over a barrel of the firearm. The elongate tube may define a proximal portion. The proximal portion may have a first aperture for providing access to an exterior surface of the barrel nut. The first wedge may be sized and configured to be received into the first aperture. The first wedge may be traversed between an engaged position wherein a contact surface of the first wedge directly contacts and applies pressure to an exterior surface of a barrel nut to frictionally hold the elongate tube onto the barrel nut of the firearm and a disengaged position wherein the first wedge does not apply sufficient pressure to hold the elongate tube on the barrel nut and allows the rail to be removed from the barrel nut. The fastener may draw the first wedge to the engaged position.

The barrel nut may be attached to a threaded proximal portion of a receiver of the firearm. The barrel nut may have a cylindrical exterior surface which receives the contact surface of the first wedge. The exterior surface of the barrel nut may have a radius which is equal to a radius of the contact surface of the first wedge.

In another aspect, a method for installing a free floating rail system on a firearm is disclosed. The method may comprise the steps of threading a barrel to an upper receiver of the firearm; threading a barrel nut to a threaded proximal portion of the barrel; tightening the barrel nut with a torque wrench; disposing a rail over the barrel and the barrel nut; drawing first and second wedges closer to each other to engage the contact surfaces of the first and second wedges against an exterior surface of the barrel nut; and contacting an entire area of the contact surface of each of the first and second wedges against the exterior surface of the barrel nut.

In the method, the drawing step may comprise the step of tightening a bolt. The drawing step may further comprises the step of centering the first and second wedges with a center of the rail.

In the method, the tightening the barrel nut may comprise the step of turning the barrel nut with a crescent wrench.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Figure 1:
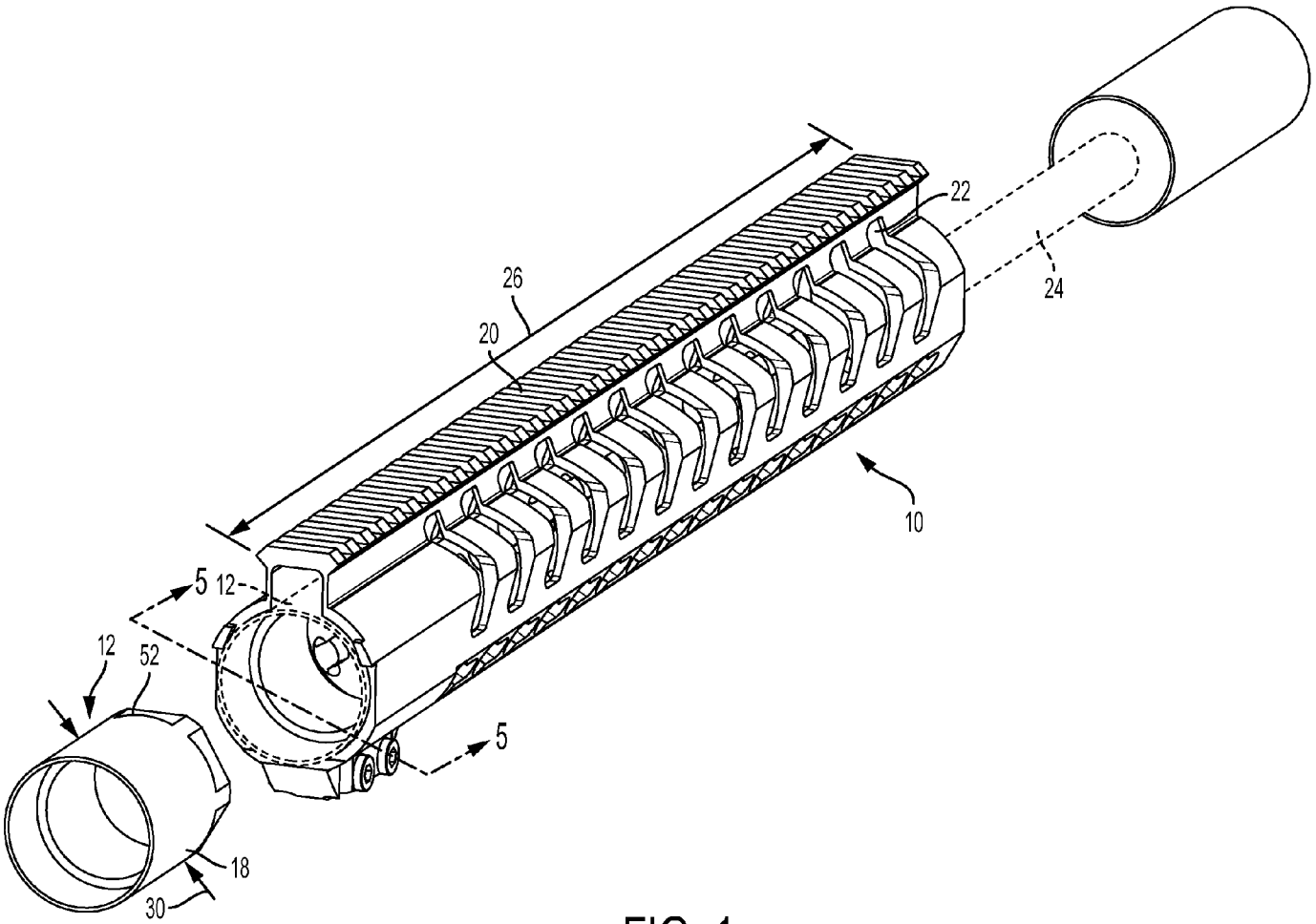
FIG. 1 is an exploded perspective view of a barrel nut and free-floating rail of a firearm.

Referring now to the drawings, a free-floating rail 10 mounted solely to a barrel nut 12 of an AR style firearm (e.g., AR-rifle or pistol) is shown. The free-floating rail is frictionally held onto the barrel nut 12 by opposing wedges 14, 16 that are secured to the free-floating rail 10 and pressed against an exterior surface 18 of the barrel nut 12. The opposing wedges 14, 16 push against the barrel nut 12 to frictionally hold the free-floating rail 10 in place. The rail is not mounted or in contact with a distal portion of the barrel 24 of the rifle. Hence, the rail is free floating.

Referring now to FIG. 1, the free-floating rail 10 and the barrel nut 12 is shown. The free-floating rail 10 provides various means for mounting accessories to the rifle including but not limited to a weaver or picatinny rail 20 or a plurality of slotted holes 22. These means for mounting accessories allow the user to mount optics, handles, lights, and other components that might be useful in a combat or competition environment. The free-floating rail 10 contacts the barrel 24 the barrel 24 at only one location, namely, a barrel nut 12 located at the base of the barrel 24. When a bullet is shot through the barrel 24, the recoil due to the traveling mass of the bullet and the gases involved may bend the barrel 24. If a rail is mounted to the barrel at two points wherein one of the points is the barrel 24, then such contact point may affect how the barrel 24 reacts during firing of the rifle, which in turn affects accuracy of the rifle. As such, it is important to mount the rail 10 in a free-floating manner to solely the barrel nut 12 or a different part of the rifle but not to a distal portion of the barrel 24 to minimize any effects that the mounting of the rail 10 may have on the natural workings of the barrel 24 when the bullet is traversed therethrough upon firing of a round.

The free-floating rail 10 may have a length 26 which depends upon a length of the barrel 24. By way of example and not limitation, the length 26 of the free-floating rail 10 may be between_inches to_inches and is preferably shorter than the barrel 24. The free-floating rail 10 is also in an optimal position to be gripped by the operator when firing the firearm.

Figure 2:
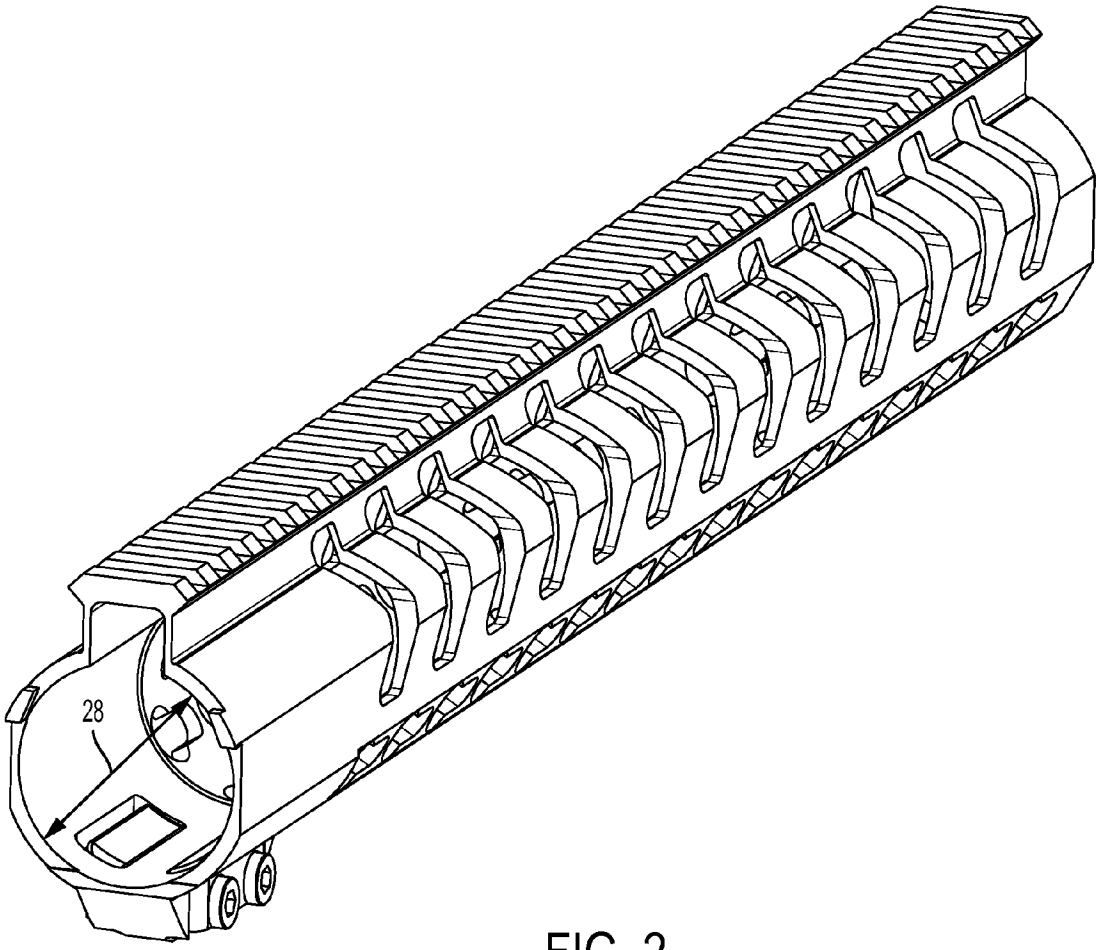
FIG. 2 is an assembled perspective view of the free-floating rail shown in FIG. 1.
Figure 3:
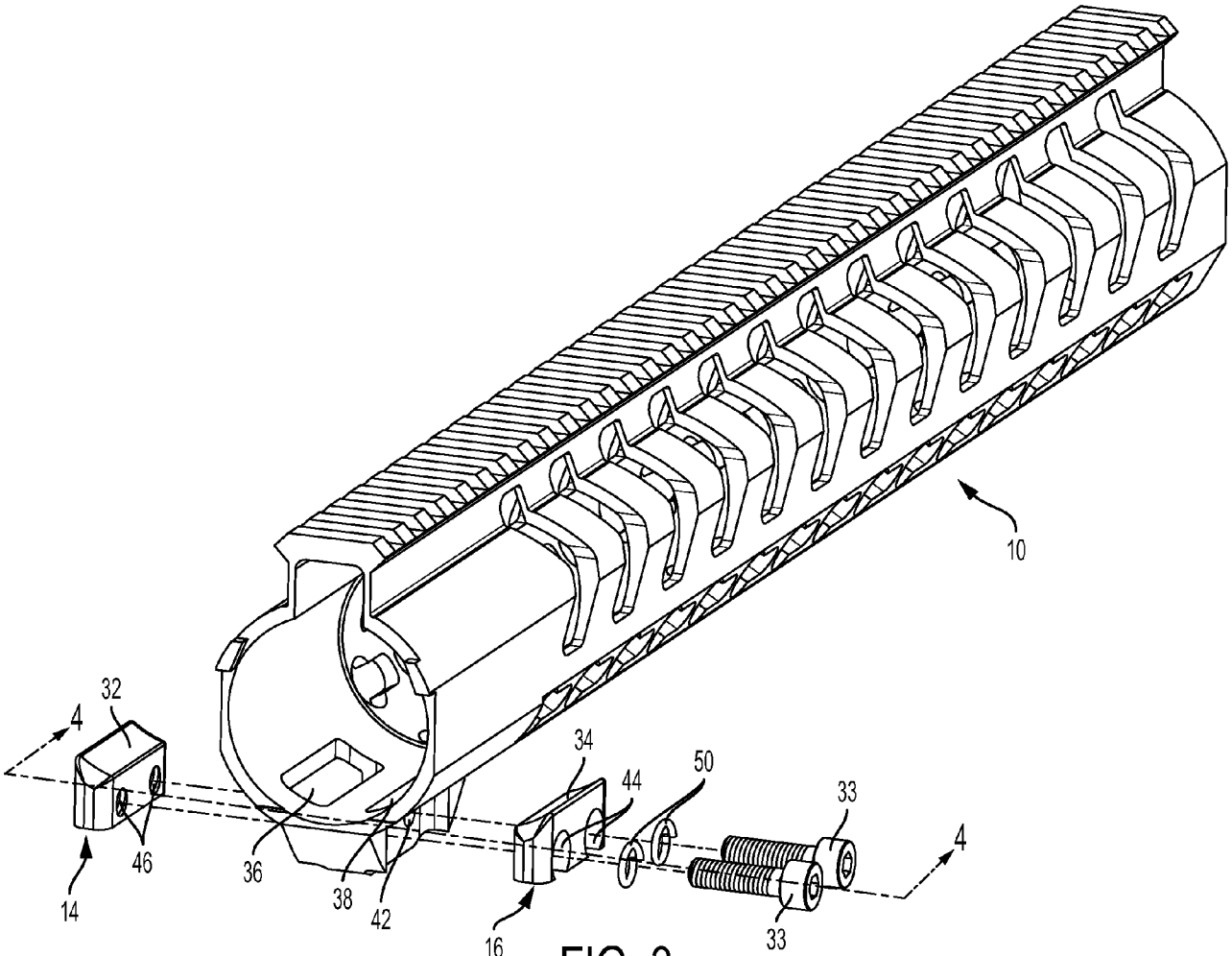
FIG. 3 is an exploded perspective view of first and second wedges used to frictionally engage the barrel nut and the free-floating rail to mount the free-floating rail to the barrel nut.

As discussed above, the free-floating rail 10 is mounted solely to the barrel nut 12. In particular, the barrel 24 is mounted to the receiver on a proximal end portion of the barrel. The barrel nut 12 is mounted to exposed threads of the receiver of the firearm. The barrel nut 12 has a smooth exterior cylindrical surface 18. The free-floating rail 10 is slipped over the barrel nut 12 and frictionally held thereto as discussed below. By way of example and not limitation, the inner diameter 28 (see FIG. 2) of the free-floating rail 10 may be 36.50 mm. The outer diameter 30 of the barrel nut 12 may be 34.30 mm. As such, the barrel nut 12 can be slipped into and out of the free-floating rail 10 fairly easily prior to frictionally engaging the free-floating rail 10 to the barrel nut 12.

The barrel nut 12 is inserted into the free-floating rail 10 until the wedges 14, 16 are aligned to the exterior surface 18 of the barrel nut 12. The wedges 14, 16 are drawn together by tightening the bolts 33 which cause contact surfaces 32, 34 of the first and second wedges 14, 16 to frictionally engage the exterior surface 18 of the barrel nut 12. The free-floating rail 10 has first and second apertures 36, 38 that allow the wedges 14, 16 to penetrate through the free-floating rail 10 to frictionally contact the exterior surface 18 of the barrel nut 12. When the bolts 33 are loosened, the contact surfaces 32, 34 of the first and second wedges 14, 16 back away from the exterior surface 18 of the barrel nut 12 and preferably do not protrude through the first and second apertures 36, 38 of the free-floating rail 10. When the bolts 33 are tightened, then the contact surfaces 32, 34 of the first and second wedges 14, 16 protrude through the first and second apertures 36, 38 to make frictional contact with the exterior surface 18 of the barrel nut 12.

Figure 4:
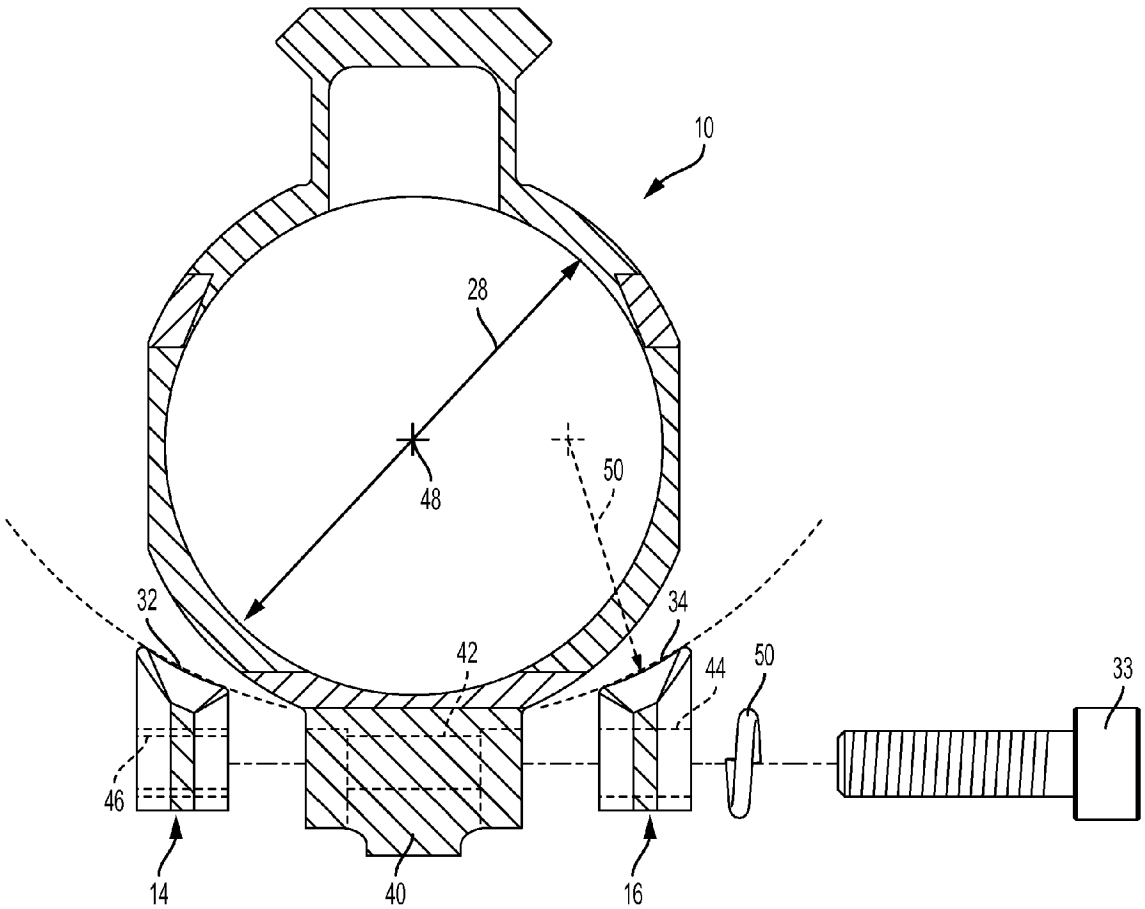
FIG. 4 is an end view of the exploded perspective view shown in FIG. 3.

The free-floating rail 10 may have a mounting base 40 that extends out from a body of the free-floating rail 10. This is shown in FIG. 4. The mounting base 40 provides through holes 42 that position the bolts 33. To assemble the first and second wedges 14, 16, the second wedge 16 has two through holes 44 through which the bolts 33 proceed. The through holes 44 may have a countersunk recess which receives the heads of the bolts 33. The bolts 33 proceed through the through holes 42 of the mounting base 40. The bolts 33 are then threaded to the threaded through holes 46 of the first wedge 14. To frictionally engage the contact surfaces 32, 34 of the first and second wedges 14, 16 to the barrel nut 12, the bolts 33 are tightened onto the threaded through hole 46 of the first wedge 14. This brings the first and second wedges 14, 16 together. The contact surfaces 32, 34 protrude through the first and second apertures 36, 38 of the free-floating rail 10 to contact and frictionally engage the exterior surface 18 of the barrel nut 12. The frictional engagement between the contact surfaces 32, 34 of the first and second wedges 14, 16 and the barrel nut 12 stops any further advancement between the first and second wedges 14, 16 together. This occurs before the first and second wedges 14, 16 bottom out on the mounting base 40. As such, the mounting base 40 is there to position the first and second wedges 14, 16 to the free-floating rail 10 and the barrel nut 12. Moreover, the mounting base 40 is centered to a center 48 of the inner diameter 28 of the free-floating rail 10. By centering the mounting base 40 to the center 48, the first and second wedges 14, 16 are also able to provide equal and opposing frictional forces against the exterior surface 18 when drawing the first and second wedges 14, 16 together with the bolts 33.

Figure 5:
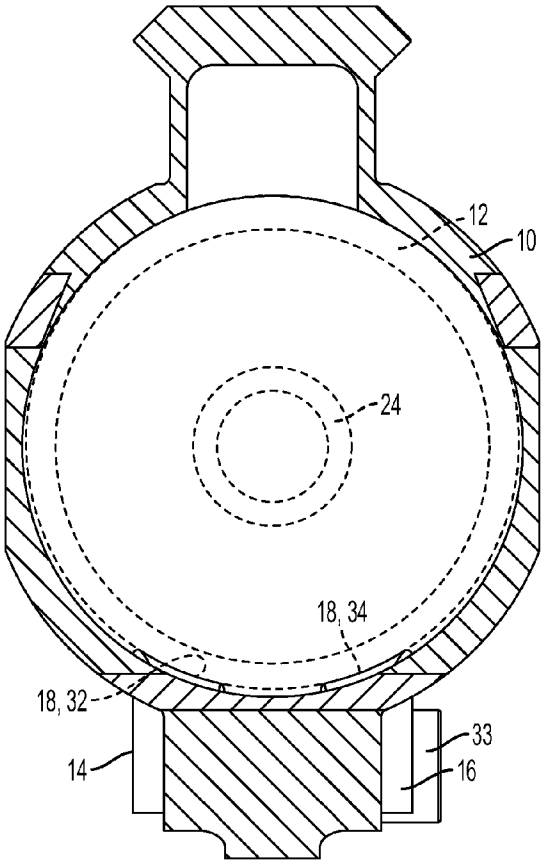
FIG. 5 is an end view of the free-floating rail shown in FIG. 1.

The contact surfaces 32, 34 of the first and second wedges 14, 16 have a curvature. The curvature is defined by radius 50 that is equal to one half the outer diameter 30 of the barrel nut 12. In other words, the radius 50 defining the contact surfaces 32, 34 is equal to a radius of the exterior surface 18 of the barrel nut 12. As such, when the contact surfaces 32, 34 engage the exterior surface 18 of the barrel nut 12, preferably, the entire area of the contact surfaces 32, 34 engages the exterior surface 18 to increase the frictional force between the contact surfaces 32, 34 of the first and second wedges 14, 16 and the exterior surface 18 of the barrel nut 12, as shown in FIG. 5

Washers 50 may also be used to prevent the bolts 33 from loosening and thereby inadvertently dislodging the free-floating rail 10 from the barrel nut 12. Alternatively, lock tight or other anti-unthreading liquid may be disposed between the threaded through holes 46 and the threads of the bolt 33.

To install the free-floating rail 10 onto the rifle, the barrel 24 is initially mounted to the upper receiver of the rifle. In this position, the distal side of the receiver has exposed threads on which the barrel nut 12 is mounted to. The barrel nut 12 has a proximal portion and a distal portion. The proximal portion may contain the smooth exterior cylindrical surface 18. The distal portion may have a hex nut configuration so that a wrench can be applied thereto in order to tighten down the barrel nut 12 onto the threaded portion of the receiver. The barrel nut 12 is disposed over the barrel 24 and traversed toward the threaded portion of the receiver at the distal side thereof. The barrel nut 12 is threaded onto the threaded portion of the receiver and tightened by applying a wrench to the hex nut configuration 52 of the barrel nut 12 until the recommended torque is achieved. Thereafter, the free-floating rail 10 is disposed over the barrel 24 and traversed toward the barrel nut 12 until the entire barrel nut 12 is received within the proximal end portion of the free-floating rail 10. The first and second wedges 14, 16, the washers 50 and the bolts 33 are attached to the mounting base 40 of the free-floating rail 10 but not tightened. With the free-floating rail 10 in position, the user applies an Allen wrench to the bolts 33 in order to tighten the first and second wedges 14, 16 against the exterior surface 18 of the barrel nut 12 to frictionally engage and mount the free-floating rail 10 to the barrel nut 12.

The above description is given by way of example, and not limitation. Given the above disclosure, one skilled in the art could devise variations that are within the scope and spirit of the invention disclosed herein, including various ways of torquing down the barrel nut 12 on the threaded portion of the receiver. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A rail mountable to a barrel nut of a firearm, the rail comprising:

an elongate tube sized and configured to fit over a barrel of the firearm, the elongate tube defining a proximal portion, the proximal portion having a through first aperture for providing access to an exterior surface of the barrel nut;

a first wedge sized and configured to be received into the through first aperture, the first wedge traversable between an engaged position wherein the first wedge directly contacts and applies pressure to the exterior surface of the barrel nut to frictionally hold the elongate tube onto the barrel nut of the firearm, and a disengaged position wherein the first wedge does not apply sufficient pressure to hold the elongate tube on the barrel nut and allows the rail to be removed from the barrel nut; and a fastener for drawing the first wedge to the engaged position, wherein the first wedge defines a first contact surface having a curvature, the curvature having a radius equal to a radius of the exterior surface of the barrel nut.

2. The rail of claim 1 further comprising:

a through second aperture formed in the proximal portion of the elongate tube for providing access to the exterior surface of the barrel nut;

a second wedge sized and configured to be received into the through second aperture, then second wedge traversable between the engaged position wherein the second wedge directly contacts and applies pressure to the exterior surface of the barrel nut.

3. The rail of claim 2 wherein the rail has a mounting base, and further comprises: a bolt insertable through through holes of the mounting base and the second wedge and threadably attachable to a threaded hole of the first wedge.

4. The rail of claim 2 wherein the second wedge defines a second contact surface having a curvature, the curvature having a radius equal to a radius of the exterior surface of the barrel nut.

5. The rail of claim 2 wherein the mounting base and the first and second wedges are centered to a center of the rail so that the first and second wedges evenly applies pressure against the barrel nut.

6. A free floating rail system for attachment to a firearm, the system comprising:

a rail mountable to a barrel nut of a firearm, the rail comprising:

an elongate tube sized and configured to fit over a barrel of the firearm, the elongate tube defining a proximal portion, the proximal portion having a through first aperture for providing access to an exterior surface of the barrel nut;

a first wedge sized and configured to be received into the through first aperture, the first wedge traversable between an engaged position wherein a contact surface of the first wedge directly contacts and applies pressure to an exterior surface of a barrel nut to frictionally hold the elongate tube onto the barrel nut of the firearm and a disengaged position wherein the first wedge does not apply sufficient pressure to hold the elongate tube on the barrel nut and allows the rail to be removed from the barrel nut;

a fastener for drawing the first wedge to the engaged position;

the barrel nut attachable to a threaded proximal portion of a receiver of the firearm, the barrel nut having a cylindrical exterior surface which receives the contact surface of the first wedge.

* * * * *